US005365912A

United States Patent [19]

Pittman

[11] Patent Number: 5,365,912

[45] Date of Patent: Nov. 22, 1994

[54] ARROW REST ASSEMBLY AND METHOD THEREOF

[76] Inventor: Leon Pittman, Rte. 2, Box 2097, Pendergrass, Ga. 30567

[21] Appl. No.: 959,140

[22] Filed: Oct. 9, 1992

[51] Int. Cl.[5] ..... F41B 5/22

[52] U.S. Cl. ..... 124/44.5; 124/24.1

[58] Field of Search ..... 124/23.1, 24.1, 44.5, 124/88, 86, 41.1

[56] References Cited

U.S. PATENT DOCUMENTS

| | | | |
|---|---|---|---|
| 3,504,659 | 4/1970 | Babington | 124/24.1 |
| 3,935,854 | 2/1976 | Troncosco, Jr. | 124/44.5 X |
| 4,664,093 | 5/1987 | Nunemaker | 124/24.1 |
| 4,685,439 | 8/1987 | Cosentino, Jr. | 124/44.5 |
| 4,838,237 | 6/1989 | Cliburn | 124/44.5 |
| 5,052,364 | 10/1991 | Martin et al. | 124/44.5 |
| 5,062,407 | 11/1991 | Newbold | 124/24.1 X |
| 5,095,884 | 3/1992 | Mertens | 124/44.5 |

OTHER PUBLICATIONS

Advertisement, *Bowhunting World,* Aug. 1992.

Advertisement, *Petersen's s Bowhunting,* Oct. 1991.

Chuck Adams, "All About Arrow Rests," *Petersen's s Bowhunting,* Oct. 1991, pp. 66–69, 80.

*Primary Examiner*—Randolph A. Reese

*Assistant Examiner*—Harry C. Kim

*Attorney, Agent, or Firm*—Hopkins & Thomas

[57] ABSTRACT

An arrow rest assembly (10) provides accurate and unimpeded shooting of an arrow (12) from a compound bow (14). A U-shaped arrow cradle (18) is configured to raise upwardly to a second position so that the arrow (12) is supported and is configured to lower downwardly to a first position away from the arrow (12) during launching. A lever arm (42) is capable of moving the arrow cradle (18) upwardly, or from the first position to the second position. To this end, a cord (44) connects the lever arm (42) with a bow cable (16*a*, 16*b*). A circular spring (38) biases the arrow cradle (18) downwardly, or toward the first position.

13 Claims, 2 Drawing Sheets

ARROW REST ASSEMBLY AND METHOD THEREOF

FIELD OF THE INVENTION

The present invention generally relates to archery and, more particularly, to an arrow rest assembly and method for providing accurate and unimpeded shooting of an arrow from a bow.

BACKGROUND OF THE INVENTION

An arrow rest assembly is a device which is mounted to a bow for supporting the arrow shaft of an arrow during the launching of the arrow from the bow. Arrow rest assemblies are intended to enhance the shooting accuracy by securing and stabilizing the front end of the arrow while the bow string is drawn backwardly away from the bow and during the release of the bow string.

Most arrow rest assemblies fall into two basic design categories: (1) side control rest assemblies and (2) launcher rest assemblies. Side control rest assemblies consist of a shelf, which the bottom of the arrow shaft sits upon, and a side plate, which one side of the arrow shaft presses against. Examples of this type of rest include the "springy" arrow rest and the "flipper-plunger" arrow rest assemblies, which are both well known in the art. Side control rest assemblies have been traditionally used with finger-released arrows, as opposed to arrows shot with mechanical bow string release aids, because of the peculiarities associated with finger-released arrows. More specifically, a finger-released arrow bends dramatically from side to side as the arrow leaves the bow, and this bending, often called "archer's paradox", must be controlled with some sort of rigid or flexible arrow plate. Hence, side control rest assemblies are an appropriate option for archers who intend to finger release their arrows.

The more accurate design choice for an arrow rest is a launcher rest assembly, which is generally used with mechanically released arrows. These arrow rest assemblies take a number of forms, but all cradle the arrow from below with two upwardly protruding, tentacle-like, support prongs. Essentially, the arrow shaft is supported by and slides securely along a launcher track formed by the two prong arrangement during the arrow draw and shooting. The fletching, or arrow feathers (3 or 4 per arrow), are oriented so that they do not contact either support prong during shooting of the arrow. Sometimes the support prongs are flexible and/or are spring-loaded in an upward position so that if fletching contact does occur, the support prongs can move downwardly to thereby minimize prong obstruction of the fletching. The configuration of launcher rest assemblies offers the significant advantage of increased accuracy by minimizing arrow shaft contact and fletching contact, while providing sufficient support and stability.

Although the launcher rest assemblies provide for better support and accuracy than the side control rests, the launcher rest assemblies are problematic when used by an archer who releases arrows with fingers. When arrows are finger-drawn, the arrow shaft tends to jump off the support prongs during release of the bow string as a result of archer's paradox described previously. Consequently, serious shooting inaccuracy occurs as well as game-spooking bow noise. Furthermore, the fletching of the arrow must be precisely oriented with the support prongs to prevent collision during shooting between the fletching and the support prongs. Big game arrows having a broad head arrow tip are especially sensitive to fletching contact with the rest assembly. Finally, when an archer hunts and carries a loaded bow around with his hand holding the bow and with his forefinger wrapped around the arrow shaft, the arrow often undesirably falls between the support prongs, thereby requiring readjustment prior to shooting.

SUMMARY OF THE INVENTION

Thus, an object of the present invention is to overcome the deficiencies and inadequacies of the prior art as noted above.

Another object of the present invention is to provide a launcher arrow rest assembly which may be easily implemented on any conventional compound bow.

Another object of the present invention is to provide an arrow rest assembly and method for optimizing accuracy and providing unimpeded shooting of an arrow from a bow.

Another object of the present invention is to provide an arrow rest assembly and method for preventing an arrow from jumping off of the arrow rest assembly during release of the bow string.

Another object of the present invention is to provide an arrow rest assembly and method for eliminating the need to precisely adjust and orient the arrow fletching in order to prevent collision of the fletching with the arrow rest assembly.

Another object of the present invention is to provide an arrow rest assembly for permitting an archer to hold the bow and wrap his forefinger around the shaft of the arrow while carrying the bow in an unaimed position during, perhaps, hunting.

Another object of the present invention is to provide an arrow rest assembly which is simple in design, inexpensive to manufacture, and efficient and reliable in operation.

Briefly described, the present invention is an arrow rest assembly for providing accurate and unimpeded shooting of an arrow from a bow. The arrow rest assembly has an arrow cradle configured to raise upwardly from an initial first position to a second position where the cradle supports the underside of an arrow while a bow string associated with the bow is drawn, or moved away from the bow. The arrow cradle is configured to quickly lower downwardly to the first position away from the arrow just after release of the bow spring. A lever arm is adapted to move the arrow cradle upwardly, or from the first position to the second position. For moving the lever arm, a connecting means, for example, a flexible cord, connects the lever arm and the bow cables of the bow. A spring biases the arrow cradle in favor of the first position and moves the arrow cradle from the second position to the first position when the bow spring is released.

The present invention may also be viewed broadly as a method for shooting an arrow, the method being independent of structure and hardware. In essence, the method comprises the steps of (1) supporting the underside of an arrow with a cradle while a bow string associated with the bow is drawn, or pulled away from the bow, and (2) forcing the cradle downwardly and away from the arrow after release of the bow string.

An important feature of the present invention is the spring for biasing the arrow cradle downwardly in favor of the first position. This feature is not present in the prior art. The novel spring arrangement forces the cradle quickly into the first position and away from the arrow shaft so as to provide unimpeded launching of the arrow from the bow.

Another important feature of the present invention is a one-piece, continuous U-shaped member of the cradle for contacting the arrow. This U-shaped men, her provides superior support for the arrow shaft and permits engagement of the arrow shaft with, for example, a forefinger, without disengagement of the arrow with the desired cradle position.

Another important feature of the present invention are the user-friendly adjustment mechanisms. There is a horizontal adjustment mechanism, two vertical adjustment mechanisms (coarse and fine), and a flexible elongated cord connecting the lever am to the bow cables, all permitting easy implementation of the novel arrow rest assembly with numerous types of conventional bows.

Other objects, features and advantages of the present invention will become apparent from the following specification read in conjunction with the accompanying drawings.

BRIEF DESCRIPTION OF THE DRAWINGS

The present invention, as defined in the claims, can be better understood with reference to the following drawings. The drawings are not necessarily to scale, emphasis instead being placed upon clearly illustrating the principles of the present invention.

DETAILED DESCRIPTION OF THE PREFERRED EMBODIMENT

Figure 1:
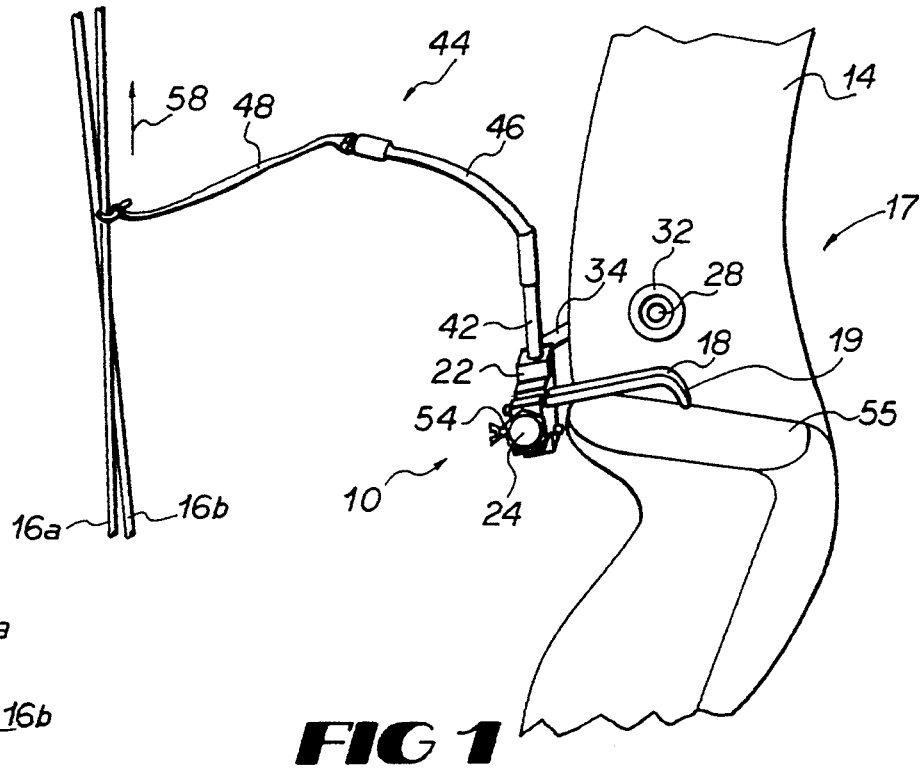
FIG. 1 is a side view of a novel arrow rest assembly in accordance with the present invention showing a cradle of the arrow rest assembly residing in a first position.
Figure 2:
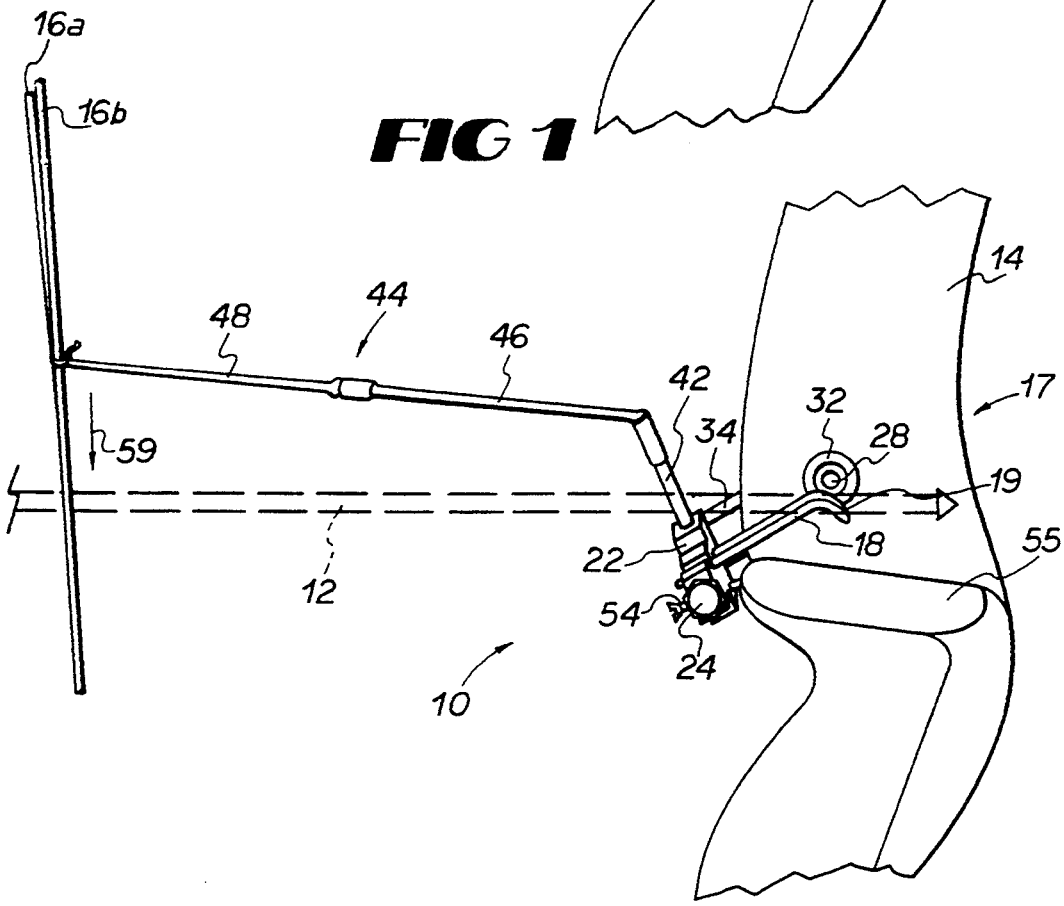
FIG. 2 shows a side view of the arrow rest assembly of FIG. 1 in a second position wherein the cradle resides in a second position supporting an arrow shaft prior to launch.
Figure 3:
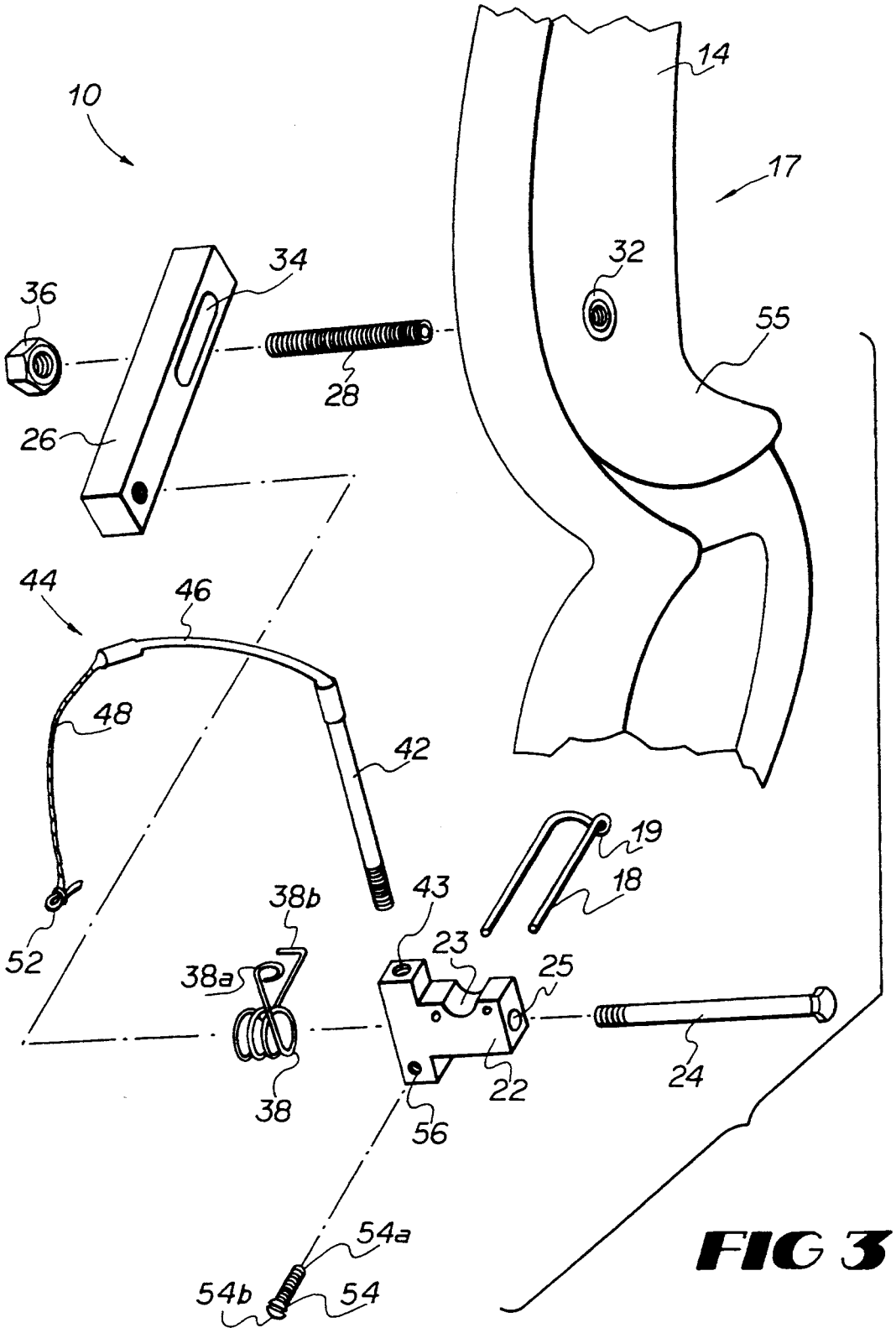
FIG. 3 shows an assembly view of the novel arrow rest assembly of FIGS. 1 and 2.

Referring now in more detail to the drawings wherein like numerals represent corresponding parts throughout the several views, a novel arrow rest assembly 10 in accordance with the present invention is illustrated in FIGS. 1–3. The arrow rest assembly 10 provides for high shooting accuracy, high arrow speed, and total unimpeded shooting of an arrow 12, shown in FIG. 2, from a compond bow 14 having pulleys (not shown) operated by bow cables 16*a*, 16*b* with a bow string (not shown) connected to the bow cables 16*a* 16*b*. The arrow rest assembly 10 is mounted in the sight window 17 of any conventional bow.

The arrow rest assembly 10 has a continuous, U-shaped arrow cradle 18 with a downwardly bending cradle tip 19 for engaging and supporting the underside of the arrow 12. The arrow cradle 18 is connected to a pivotal mounting block 22 which has a U-shaped aperture 23 and which pivots about an elongated axis member 24. The elongated axis member 24 passes through an aperture 25 of the pivotal mounting block 22. Preferably, the elongated axis member 24 is a bolt having a smooth shoulder for permitting free frictionless rotation of the pivotal mounting block 22 about the elongated axis member 24.

The elongated axis member 24 is mounted to an adjustable arm member 26 via threaded male and female mating engagement, respectively. Further, the adjustable arm member 26 is mounted to the bow 14 via a threaded elongated axis member 28 passing through a threaded hub 32 in the bow 14 at one end, and at the other end, passing through an elongated adjustment aperture 34 in the arm member 26 and then into an affixing mechanism, for example, a threaded lock nut 36.

The arrow rest assembly 10 may be adjusted horizontally by loosening the lock nut 36 and moving the adjustable arm member 26 side to side about the threaded elongated axis member 28, thereby horizontally moving the arrow cradle 18 either closer to or further away from the bow 14.

Without any pulling force on the bow string away from the bow 14, the pivotal mounting block 22 is forced to rotate about the elongated axis member 24 via a circular spring 38 so that the arrow cradle 18 is forced downwardly in a direction away from the arrow 12. The circular spring 38 coils around the elongated axis member 24 and presses against the upper end of the pivotal mounting block 22 at a looped first end 38*a*, and at a second end 38*b*, the circular spring 38 engages the underside of the adjustable arm member 26. Essentially, the circular spring 38 creates a separating force between the pivotal mounting block 22 and the adjustable arm member 26, thereby forcing the arrow cradle 18 downwardly.

An elongated lever arm 42 is disposed substantially orthogonally with respect to the elongated axis member 24. The lever arm 42 fixedly mounts in an aperture 43 of the pivotal mounting block 22 via threaded male and female mating engagement, respectively. The lever arm 42 is adapted to rotate the pivotal mounting block 22 about the elongated axis member 24. A connecting cord 44 connects the lever arm 42 with the bow string (not shown) of the bow 14. The cord 44 preferably comprises a flexible rubber tubing 46 affixed at one end to the distal end of the lever arm 42, and at the other end, to a nonflexible cable 48 having an aperture 52 for attachment to a bow cable 16*a*, 16*b*.

The arrow rest assembly 10 further comprises two vertical adjustment mechanisms, coarse and fine, for adjusting the vertical level of arrow support provided by the arrow cradle 18. A coarse vertical adjustment mechanism includes the adjustable arm member 26, the elongated axis members 24, 28, and the elongated aperture 34. The position of the elongated axis member 28 passing through the aperture 34 and the physical orientation of the adjustable arm member 26 relative to the axis members 24, 28 permits the user to orient the pivotal mounting block 22 and the arrow cradle 18 in variety of vertical position.

In addition, the arrow rest assembly 10 comprises a fine vertical adjustment mechanism. A set screw 54 passes through a threaded aperture 56 in the pivotal mounting block 22 to thereby contact the bow 14 at a first end 54*a*. At a second end 54*b* of the set screw 54, the set screw 54 may be turned clockwise or counterclockwise to selectively rotate the rotatable mounting block 22 about the elongated axis member 24 in small increments to thereby raise and lower the arrow cradle 18.

OPERATION

Initially, as illustrated in FIG. 1, the pivotal mounting block 22 is forced in a clockwise rotation about the axis member 24 via the circular spring 38 (FIG. 3). Rotation of the pivotal mounting block 22 about the axis member 24 is stopped by engagement of the arrow cradle 18 with the bottom 55 of the sight window corresponding with the bow 14. The arrow cradle 18 is now in a first position.

The arrow 12 is inserted on the bow and arrow arrangement. The arrow shaft is disposed to engage the cradle tip 19, pass between the U-shaped arrow cradle 18, and pass through a U-shaped passthrough 23 of the pivotal mounting block 22. The nock (not shown) of the arrow 12 is engaged with the bow string of the bow 14.

As the bow string of the bow 14 is pulled backwardly away from the bow 14, the bow cable **16*b* is moved upwardly as indicated by an arrow 58 of FIG. 1, thereby creating pulling tension in the cord 44 and causing the lever arm 42 to be pulled backwardly toward the bow cables 16*a*, 16*b*. 2. Movement of the lever arm 42 in a backward direction causes counterclockwise rotation of the pivotal mounting block 22 about the elongated axis member 24. Counterclockwise rotation of the pivotal mounting block 22 forces the arrow cradle 18 in an upward direction, as illustrated in FIG. 2, and raises the arrow 12 from engagement with the U-shaped passthrough of the mounting block 22. The arrow cradle 18** is now in a transitional and temporary second position.

When the bow string is released by the user, the bow cable **16*b* moves abruptly downwardly, as illustrated by an arrow 59 in FIG. 2, to thereby deplete the pulling tension in the cord 44. As a result, the circular spring 38 (FIG. 3) causes the pivotal mounting block 22 to rotate counterclockwise about the axis member 24 so that the arrow cradle 18 is quickly moved downwardly away from the arrow 12 as the arrow 12 passes horizontally by and adjacent to the bow 14. In essence, the arrow rest assembly 10 assumes the initial first position as indicated in FIG. 1**.

The features and principles of the present invention have been described and illustrated with reference to a preferred embodiment. It will be apparent to those skilled in the art that numerous modifications may be made to the preferred embodiment without departing from the spirit and scope of the present invention. All such modifications are intended to be incorporated within the scope of the present invention, as defined hereinafter in the claims.

Wherefore, the following is claimed:

1. An arrow rest assembly for a bow, comprising:

an arrow cradle;

first means for causing said arrow cradle to support an underside of an arrow while a bow string associated with said bow is moved away from said bow;

second means for forcing said arrow cradle away from said arrow after release of said bow string;

a coarse vertical adjustment means for adjusting a vertical level of arrow support provided by said arrow cradle, said coarse vertical adjustment means comprising an adjustable arm member configured to support at a first end an elongated axis member and adjustably mounted at a second end to said bow; and a fine vertical adjustment means for finely adjusting said vertical level, said fine vertical adjustment means comprising a set screw situated transversely relative to said elongated axis member and adapted to selectively rotate said arrow cradle about said elongated axis member by turning of said set screw to thereby raise and lower said arrow cradle.

2. The arrow rest assembly of claim 1, wherein said arrow cradle comprises a one-piece member configured to hold said arrow.

3. The arrow rest assembly of claim 2, wherein said arrow cradle comprises a continuous U-shaped member.

4. The arrow rest assembly of claim 1, wherein said first means comprises:

a pivotal mounting means pivotal about said elongated axis member mounted to said bow, said arrow cradle being affixed to and pivotal with pivoting motion of said pivotal mounting means; and a connecting means for connecting said pivotal mounting means to bow cables associated with said bow, said connecting means for pivoting said pivotal mounting means so that said arrow cradle moves toward said arrow when said bow string is moved away from said bow.

5. The arrow rest assembly of claim 4, wherein said connecting means comprises a flexible elongated cord member connected to a lever arm affixed to and protruding outwardly from said pivotal mounting means.

6. The arrow rest assembly of claim 4 wherein said second means comprises a spring which is configured to exert rotational force against said pivotal mounting means about said elongated axis member.

7. An arrow rest assembly for providing accurate and unimpeded shooting of an arrow from a compound bow having pulleys surrounded by bow cables with a bow string connected to the bow cables, comprising:

an arrow cradle configured to move downwardly to a first position away from said arrow and configured to move upwardly to a second position so that said arrow is supported;

a lever arm adapted to move said arrow cradle from said first position to said second position;

connecting means for connecting said lever arm and said bow cables;

a spring for biasing said arrow cradle toward said first position;

a coarse vertical adjustment means for adjusting a vertical level of arrow support provided by said arrow cradle, said coarse vertical adjustment means comprising an adjustable arm member configured to support at a first end an elongated axis member and adjustably mounted at a second end to said bow; and a fine vertical adjustment means for finely adjusting said vertical level, said fine vertical adjustment means comprising a set screw situated transversely relative to said elongated axis member, said set screw passing through a threaded aperture in said arrow cradle and having a distal end for contacting said bow and for defining a distance between said bow and said lever arm, said set screw for permitting selective rotation of said arrow cradle about said elongated axis member by selective rotation of said set screw.

8. The arrow rest assembly of claim 7, wherein said arrow cradle comprises a U-shaped member for contacting said arrow, said U-shaped member having a first end and a second end, said first end having a U-shaped support, said second end having a pair of distal members.

9. The arrow rest assembly of claim 7, wherein said arrow cradle is partially rotatable about said elongated axis member.

10. The arrow rest assembly of claim 7, wherein said connecting means comprises a flexible cord.

11. The arrow rest assembly of claim 7, wherein said spring exerts rotational force against said arrow cradle so that said arrow cradle is biased about said elongated axis member.

12. A compound bow having the arrow rest assembly of claim 7.

13. An apparatus having an arrow rest assembly for providing accurate and unimpeded shooting of an arrow from compound bows, comprising:

a compound bow having pulleys surrounded by bow cables with a bow string connected to the bow cables;

an arrow cradle configured to lower downwardly to a first position away from said arrow and configured to raise upwardly to a second position so that said arrow is supported, said arrow cradle being partially rotatable about an elongated axis member mounted adjacent to said bow;

a lever arm adapted to move said arrow cradle from said first position to said second position;

connecting means for connecting said lever arm and said bow cables;

a spring for biasing said arrow cradle toward said first position;

a vertical adjustment means for adjusting a vertical level of arrow support provided by said arrow cradle, said vertical adjustment means comprising an adjustable arm member configured to support at a first end said elongated axis member and adjustably mounted at a second end to said bow;

a fine vertical adjustment means for finely adjusting said vertical level, said fine vertical adjustment means comprising a set screw disposed through a threaded aperture in said arrow cradle, said set screw having a distal end for contacting said bow and for defining a distance between said bow and said lever arm, said set screw adapted to rotate said arrow cradle about said elongated axis member when said set screw is turned to thereby raise and lower said arrow cradle;

whereby said lever arm moves said arrow cradle from said first position to said second position while said bow cables move substantially vertically in response to said bow string being moved away from said bow and said spring moves said arrow cradle from said second position to said first position once said bow string is released.

* * * * *